US006935799B2

(12) United States Patent
Kageyama

(10) Patent No.: US 6,935,799 B2
(45) Date of Patent: Aug. 30, 2005

(54) STICK-LIKE OBJECT RECEIVING MEMBER AND BARREL PROVIDED WITH STICK-LIKE OBJECT RECEIVING MEMBER

(75) Inventor: Hidehei Kageyama, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 42 days.

(21) Appl. No.: 10/642,198

(22) Filed: Aug. 18, 2003

(65) Prior Publication Data

US 2004/0037609 A1 Feb. 26, 2004

(30) Foreign Application Priority Data

Aug. 23, 2002 (JP) ..... 2002-244279

(51) Int. Cl.[7] ..... B43K 25/00; B43K 23/12; B43K 29/02

(52) U.S. Cl. ..... 401/52; 401/247; 15/431; 15/427

(58) Field of Search ..... 401/52, 88, 202, 401/243, 247; 15/424–434

(56) References Cited

U.S. PATENT DOCUMENTS 1,815,309 A * 7/1931 John ..... 15/432
1,923,153 A 8/1933 Lang
1,946,085 A * 2/1934 Lungren ..... 401/86
2,239,526 A * 4/1941 Juelss ..... 15/432
2,524,716 A * 10/1950 Ross ..... 15/105.51
5,051,015 A 9/1991 Moeck
5,066,156 A 11/1991 Petrillo et al.
5,897,266 A 4/1999 Robert

FOREIGN PATENT DOCUMENTS

EP 0 863 023 A2 9/1998
JP 2001-504764 4/2001

* cited by examiner

*Primary Examiner*—David J. Walczak
(74) *Attorney, Agent, or Firm*—McGinn & Gibb, PLLC

(57) ABSTRACT

In a stick-like object receiving member having safety precautions, which receives a stick-like object, a sufficient air passage is secured without exerting an influence on the size of the stick-like object or the receiving member. An eraser receiving member 16, which is the stick-like object receiving member, includes a cylindrical side portion 16*b* which engages with at least a part of the outer peripheral surface of an eraser 13, and surrounds at least a part of the outer peripheral surface of the eraser 13, and a bottom portion 16*a* which closes one end of the cylindrical side portion 16*b*. A slit 16*e* is formed in the cylindrical side portion 16*b* and bottom portion 16*a* so as to penetrate the cylindrical side portion 16*b* and bottom portion 16*a* in the axial direction, and the slit 16*e* serves as an air passage.

20 Claims, 5 Drawing Sheets

STICK-LIKE OBJECT RECEIVING MEMBER AND BARREL PROVIDED WITH STICK-LIKE OBJECT RECEIVING MEMBER

BACKGROUND OF THE INVENTION

1. Field of the Invention

The present invention relates to a stick-like object receiving member used for a writing instrument etc. and, more particularly, to a stick-like object receiving member having safety precautions and a barrel provided with the stick-like object receiving member.

2. Description of the Related Art

As an example of a conventional stick-like object receiving member of this type, there is an eraser receiving member that is mounted in the end portion of a writing instrument to receive an eraser. This eraser receiving member can be removed from the body of the writing instrument as it is mounted detachably to the end portion of the writing instrument, and it is considerably smaller than the writing instrument as a whole in this state. Considering a case where the eraser receiving member or the writing instrument is swallowed inadvertently in a state in which the eraser receiving member is removed from the body of writing instrument or in a state in which the eraser receiving member is mounted, it is necessary to provide safety precautions to the eraser receiving member to secure the airway.

As an eraser receiving member provided with such safety precautions, for example, a safety cap described in National Publication of International Patent Application No. 2001-504764 is known. The safety cap described in this Publication has a cylindrical hollow body, an eraser formed of a substantially solid material, which is accommodated in one end of the hollow body and has a portion extending beyond the end of the body, and an air passage disposed between the outer peripheral surface of the eraser and the inner peripheral surface of the body to secure the airway from one end of the body via the body. This air passage is created as a space formed between the inner peripheral surface of the body and the outer peripheral surface of the eraser by a plurality of protrusions formed on the inner peripheral surface of the body or by a plurality of protrusions formed on the outer peripheral surface of the eraser.

However, the safety cap described in this Publication utilizes the small protrusions formed on the inner peripheral surface of the body or on the outer peripheral surface of the eraser to form the air passage, and thus presents a problem in that only a very narrow gap is formed between the inner peripheral surface of the body and the outer peripheral surface of the eraser, which is not satisfactory for the air passage. In order to form a large air passage, the heights of protrusions must be increased. In this case, however, the outside diameter of eraser becomes small, so that the eraser itself must be made small. Maintaining the size of eraser makes it necessary to increase the inside diameter of body. This results in the increased size of body, and may adversely affect the design of writing instrument.

SUMMARY OF THE INVENTION

The present invention has been made to solve the above problem, and accordingly an object thereof is to provide a stick-like object receiving member having safety precautions capable of securing a sufficient air passage without exerting an influence on the size of a stick-like object or a receiving member, and a barrel provided with the stick-like object receiving member.

To achieve the above object, a stick-like object receiving member with safety precautions for receiving a stick-like object according to the present invention, includes a cylindrical side portion which engages with at least a part of the outer peripheral surface of the stick-like object and surrounds at least a part of the outer peripheral surface of the stick-like object, and a bottom portion which closes one end of the cylindrical side portion. A slit is formed in the cylindrical side portion and bottom portion so as to penetrate the cylindrical side portion and bottom portion in the axial direction, and the slit serves as an air passage.

In a state in which the stick-like object engages with the cylindrical side portion, a portion in which the slit penetrating the cylindrical side portion and bottom portion in the axial direction is depressed to the inside diameter side as compared with the cylindrical side portion, and thus the slit serves as an air passage. Therefore, even if the stick-like object receiving member is swallowed, the airway can be secured by the air passage formed by the slit. The slit, which forms an air passage, is formed in the cylindrical side portion and the bottom portion. Since this configuration is different from a conventional configuration in which an air passage is formed between the inner peripheral surface of the cylindrical side portion and the outer peripheral surface of the stick-like object, the air passage can be formed and also the size of air passage can be adjusted without exerting an influence on the inside diameter of cylindrical side portion or the outside diameter of stick-like object.

A plurality of the slits can be formed at intervals in the circumferential direction. Thereby, a large cross-sectional area of air passage can be secured.

The cylindrical side portion can have a collar portion protruding outward in the radial direction on the other end thereof.

Also, the present invention provides a barrel having the above-described stick-like object receiving member and a cylindrical casing in which the stick-like object receiving member is mounted detachably at one end thereof.

Further, a barrel, according to the present invention, having the stick-like object receiving member is provided with the cylindrical side portion having the collar portion and a cylindrical casing in which the stick-like object receiving member is mounted detachably at one end thereof. The barrel includes an end face to which the collar portion of the stick-like object receiving member is locked, an inner peripheral surface which engages with at least a part of the cylindrical side portion of the stick-like object receiving member other than the collar portion and surrounds the outer peripheral surface of the cylindrical side portion other than the collar portion, and a step portion formed on the inner peripheral surface so as to be separated from the bottom portion of the stick-like object receiving member. A gap formed between the step portion and the bottom portion communicates with the slit and forms an air passage together with the slit.

The present disclosure relates to subject matter contained in Japanese Patent Application No. 2002-244279, filed on Aug. 23, 2002, which is expressly incorporated herein by reference in its entirety.

DETAILED DESCRIPTION OF THE PREFERRED EMBODIMENTS

An embodiment of the present invention will now be described with reference to the accompanying drawings.

Figure 1:
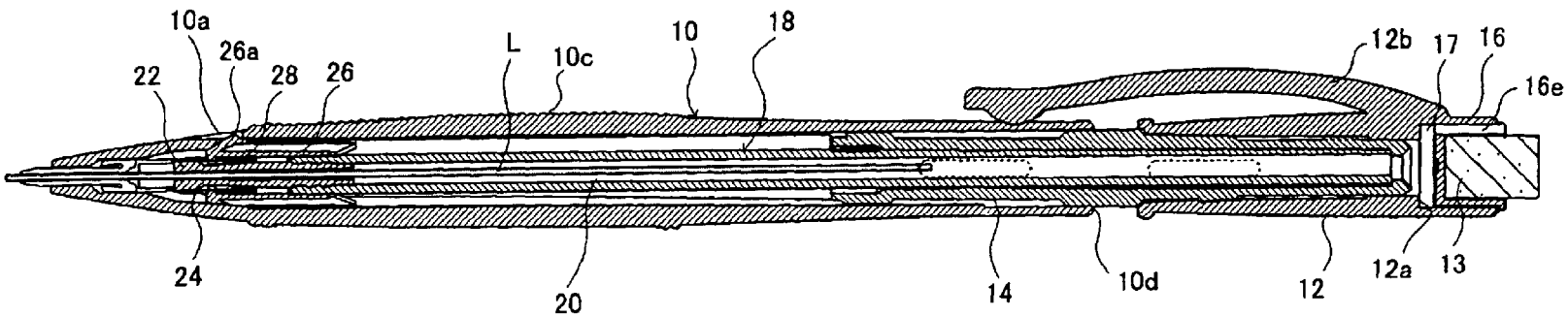
FIG. 1 is a longitudinal sectional view of a writing instrument provided with a stick-like object receiving member in accordance with the present invention.

FIG. 1 is a longitudinal sectional view of a writing instrument provided with a stick-like object receiving member in accordance with the present invention. In this example, a mechanical pencil is taken as an example of writing instrument. However, the writing instrument is not limited to the mechanical pencil, and the present invention can be applied to any type of writing instrument such as ball-point pen, felt pen, fountain pen, and stylus pen. This mechanical pencil mainly has an external casing 10, a knock casing 12, and an intermediate casing 14, and a lead delivering mechanism 18 for delivering a lead is incorporated in the external casing 10. As publicly known, the lead delivering mechanism 18 includes a lead tank 20 for storing a lead L, a lead tightening chuck 22 whose rear end is pressed into the lead tank 20 and whose front end portion tightens the lead L, a chuck ring 24 which is disposed on the outer periphery side of the lead tightening chuck 22 to tighten the lead tightening chuck 22, a sleeve 26 for regulating the rearward movement of the chuck ring 24, and a chuck spring 28 interposed between the sleeve 26 and the front end of the lead tank 20 to always urge the lead tank 20 and the lead tightening chuck 22 rearward. An elastic blade portion 26*a* formed on the sleeve 26 is locked to an opening 10*a* formed in the external casing 10, by which the lead delivering mechanism 18 is held in the external casing 10.

The rear end of the lead tank 20 protrudes and extends from a rear end opening 10*d* of the external casing 10 so as to be capable of accommodating a lead longer than the total length of the external casing 10. In an annular space between the inner peripheral surface at the rear of the external casing 10 and the outer peripheral surface at the rear of the lead tank 20, the tip end of the intermediate casing 14 is inserted, and is fitted in the annular space. The tip end of the intermediate casing 14 is connected to the lead tank 20. Also, the rear end of the intermediate casing 14 is connected to the knock casing 12. The connecting force between the intermediate casing 14 and the knock casing 12 is set so as to be weaker than the connecting force between intermediate casing 14 and the lead tank 20 so that the knock casing 12 is detachable from the intermediate casing l4. Thus, the knock casing 12 is detachable with respect to the intermediate casing 14 and the external casing 10.

The knock casing 12 is integrally formed with a clip 12*b* on the outside surface thereof. Also, at the rear end of the knock casing 12, an eraser receiving member 16, which is a stick-like object receiving member, for receiving an eraser 13, which is a stick-like object, is mounted detachably. The stick-like object is not limited to the eraser 13, and an arbitrary object such as an error-correcting stick, solid paste, and marker can be received by the stick-like object receiving member 16. The length in the axial direction of stick-like object need not necessarily be larger than the outside diameter thereof, but the stick-like object is supposed to b solid so that air cannot flow freely therein.

Figures 2A, 2B:
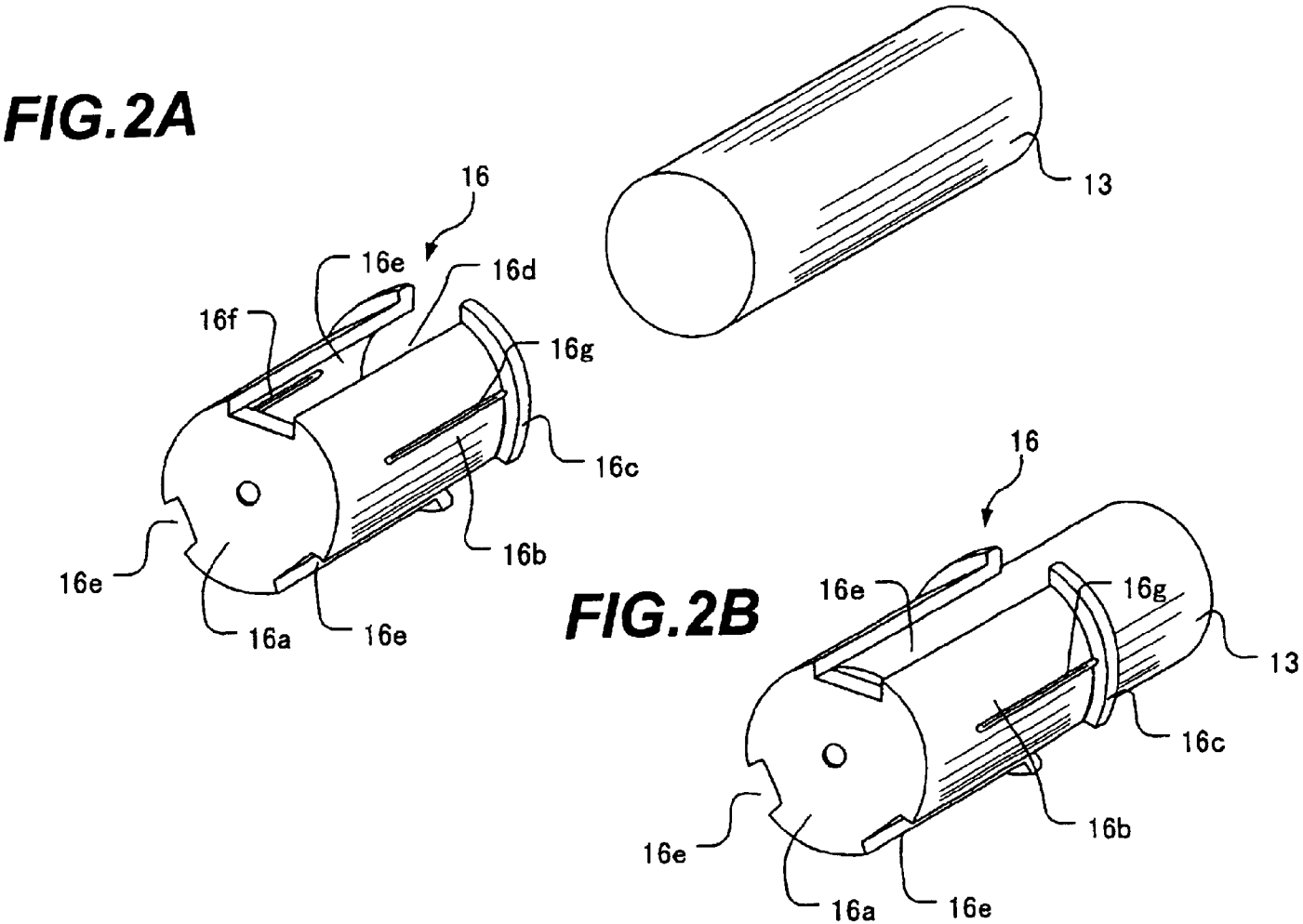
FIG. 2A is a perspective view of a stick-like object and a stick-like object receiving member.
FIG. 2B is a perspective view showing a state in which the stick-like object is inserted in the stick-like object receiving member.
Figure 3A:
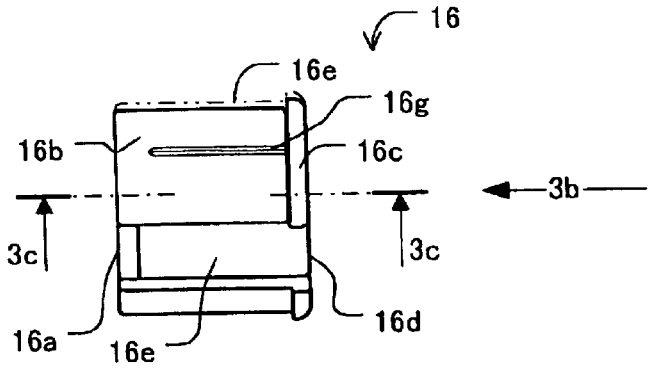
FIG. 3A is a side view of a stick-like object receiving member.
Figure 3B:
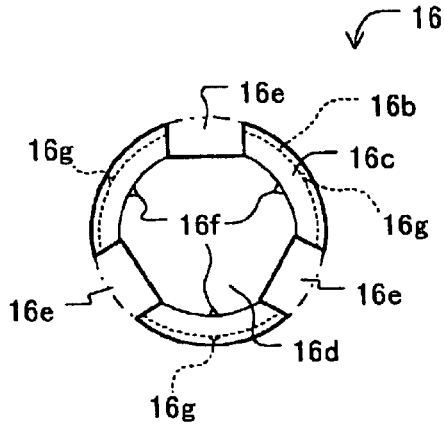
FIG. 3B is a view taken in the direction of arrow 3*b* of FIG. 3A.
Figure 3C:
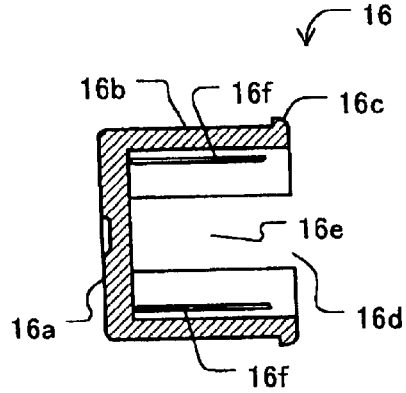
FIG. 3C is a sectional view taken along the line 3*c*—3*c* of FIG. 3A.

As shown in FIGS. 2 and 3, the eraser receiving member 16 has a bottom portion 16*a* for receiving the bottom surface of the eraser 13, a cylindrical side portion 16*b* which engages with a part of the outer peripheral surface of the eraser 13 and surrounds the part of the outer peripheral surface of the eraser 13, one end thereof being closed by the bottom portion 16*a*, and an opening portion 16*d* which opens at the other end of the cylindrical side portion 16*b* so as to face the bottom portion 16*a*. The eraser 13 protrudes from the eraser receiving member 16 through the opening portion 16*d* so that it can be used. The cylindrical side portion 16*b* has a collar portion 16*c*, which protrudes in the radial direction to be brought into contact with the rear end of the knock casing 12, on the side of opening portion 16*d*.

Furthermore, the eraser receiving member 16 is formed with a slit 16*e* which extends so as to penetrate the cylindrical side portion 16*b* and the bottom portion 16*a* in the axial direction to form an air passage. The number of the slits 16*e* can be made one. Also, as in the example shown in the figures, a plurality of (three in this example) slits 16*e* can be formed at intervals in the circumferential direction. The slit 16*e* need not necessarily extend in parallel with the axial direction, or n ed not extend straight.

Also, on the inner peripheral surface of the cylindrical side portion 16*b* of the eraser receiving member 16, ribs 16*f* for engagement with the eraser 13 are formed at appropriate places, and on the outer peripheral surface of the cylindrical side portion 16*b*, ribs 16*g* for engagement with the knock casing 12 are formed at appropriate places. By adjusting the height and number of the ribs 16*f* and 16*g*, the engagement forces between the eraser receiving member 16 and the engaging mating elements can be adjusted. The engagement force between the eraser receiving member 16 and the knock casing 12 is set so as to be larger than the engagement force between the eraser receiving member 16 and the eraser 13. The ribs 16*f* and 16*g* are ribs for engagement, and therefore the protrusion height thereof is relatively small. Therefore, a gap formed between the inner peripheral surface of the cylindrical side portion 16*b* of the eraser receiving member 16 and the outer peripheral surface of the eraser 13 by the rib 16*f* is very small even if it exists, so that the gap cannot serve as an air passage. Similarly, a gap formed between the outer peripheral surface of the cylindrical side portion 16*b* of the eraser receiving member 16 and the inner peripheral surface of the knock casing 12 by the rib 16*g* is very small even if it exists, so that the gap cannot serve as an air passage. When one end of the eraser 13 is inserted in the eraser receiving member 16 through the opening portion 16*d*, the outer peripheral surface of the one end portion engages with the inner peripheral surface of the cylindrical side portion 16*b*. When the eraser 13 has not be used yet, the eraser 13 is inserted to a position at which the bottom surface of the eraser 13 comes into contact with the bottom portion 16*a* of the eraser receiving member 16.

Figure 4:
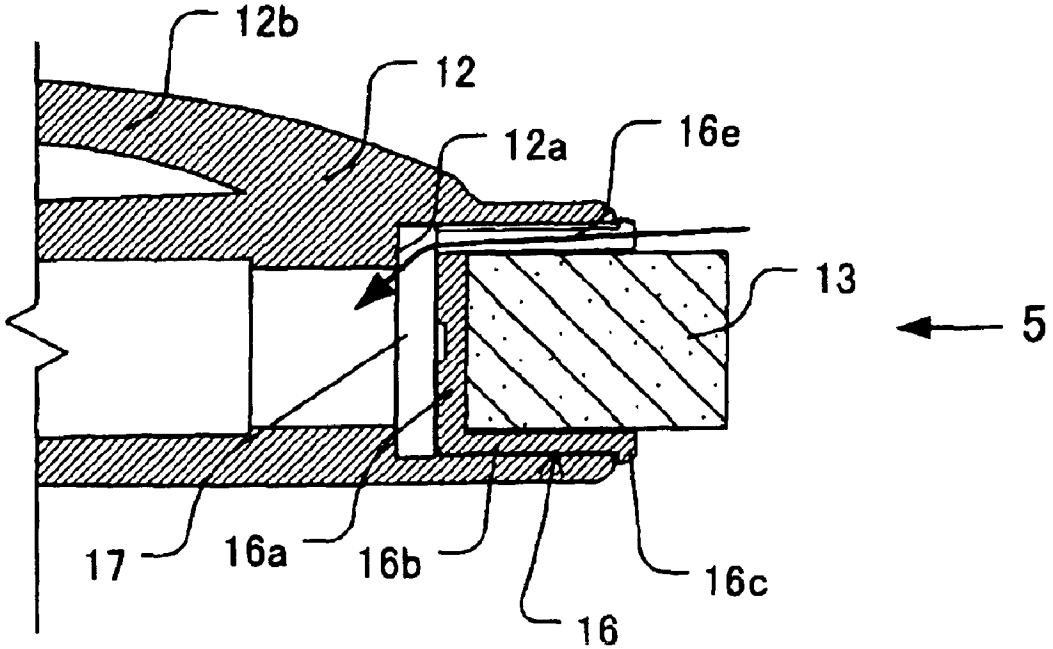
FIG. 4 is a partially sectional view of an essential portion showing a state in which a stick-like object receiving member is mounted in a knock casing.

As shown in FIG. 4, when the eraser receiving member 16 is mounted in the knock casing 12, the collar portion 16*c* of the eraser receiving member 16 is locked to the rear end face of the knock casing 12, and the outer peripheral surface of the cylindrical side portion 16*b* other than the collar portion 16*c* engages with the inner peripheral surface of the rear end portion of the knock casing 12. At this time, the bottom portion 16*a* of the eraser receiving member 16 does not come into contact with the knock casing 12, and a gap 17 is formed between the bottom portion 16*a* of the eraser receiving member 16 and a step portion 12*a* formed on the inner peripheral surface of the knock casing 12.

In the eraser receiving member 16 constructed as described above, as shown in FIG. 2B, in the state in which the eraser receiving member 16 is removed from the knock casing 12, the portion of the slit 16*e* penetrates in the axial direction over the entire length of the eraser receiving member 16, and the portion of the slit 16*e* is depressed to the inside diameter side as compared with the cylindrical side surface 16*b*, so that the slit 16 serves as an air passage. Therefore, even if the eras r receiving member 16 is swallowed and, for example, the collar portion 16*c* is caught by any portion, the airway can be secured by the air passage formed by the slit 16*e*.

Figure 5:
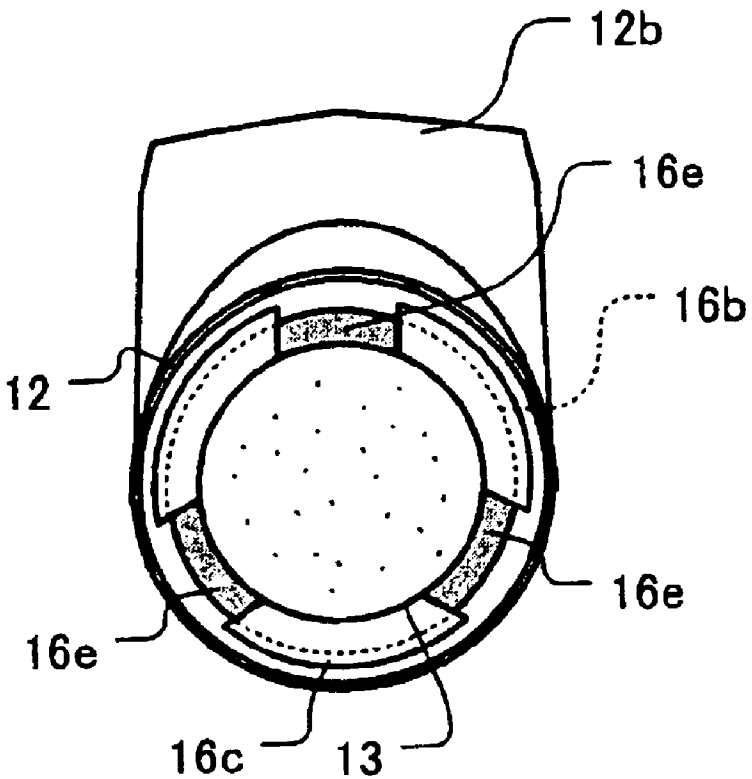
FIG. 5 is a view taken in the direction of arrow 5 of FIG. 4.

Also, as shown in FIG. 4, even in a state in which the eraser receiving member 16 is mounted in the knock casing 12 (a combination of the eraser receiving member 16 and the knock casing 12 in the state in which the eraser receiving member 16 is mounted in the knock casing 12 is referred to as a "barrel"), the portion of the slit 16*e* penetrates the eraser receiving member 16 in the axial direction, and the portion of the slit 16*e* is depressed to the inside diameter side as compared with the cylindrical side surface 16*b* to form a gap between the inner peripheral surface of the knock casing 12 and the eraser receiving member 16, so that the slit 16*e* serves as an air passage. In FIG. 5, the colored portions indicate air passages formed by the slits 16*e*. Further, the gap 17 formed between the bottom portion 16*a* of the eraser receiving member 16 and the step portion 12*a* of the knock casing 12 serves as an air passage communicating with the air passage formed by the slit 16*e*. Therefore, even if the eraser receiving member 16 is swallowed together with the knock casing 12, the airway can be secured by the slit 16*e* and the gap 17.

As described above, according to the present invention, since the slit 16*e* formed so as to penetrate the cylindrical side portion 16*b* and the bottom portion 16*a* of the eraser receiving member 16 is used as an air passage, the air passage does not at all affect the inside diameter of the eraser receiving member 16 or the outside diameter of the eraser 13. Therefore, the eraser receiving member 16 and the eraser 13 can have a desired size. In addition, by setting the width, number, etc. of the slits 16*e* properly, the cross-sectional area of slits 16*e* colored in FIG. 5 can be adjusted arbitrarily, and thereby a cross-sectional area sufficient as an air passage can be secured.

While the principles of the invention have been described above in connection with specific embodiments, and particular modifications thereof, it is to be clearly understood that this description is made only by way of example and not as a limitation on the scope of invention.

What is claimed is:

1. An instrument comprising:

a stick-like object receiving member for receiving a stick-like object, comprising:

a cylindrical side portion which engages with at least a part of the outer peripheral surface of the stick-like object and surrounds at least a part of the outer peripheral surface of the stick-like object, and a bottom portion which closes one end of said cylindrical side portion, and the stick-like object receiving member having safety precautions, wherein a slit is formed in said cylindrical side portion and bottom portion so as to penetrate said cylindrical side portion and bottom portion in the axial direction to provide an air passage of the stick-like object receiving member; and a barrel comprising:

a cylindrical casing having one end within which said stick-like object receiving member is detachably mounted;

an end face to which a collar portion of the stick-like object receiving member is locked;

an inner peripheral surface which engages with at least part of said cylindrical side portion of the stick-like object receiving member and surrounds the outer peripheral surface of said cylindrical side portion; and a step portion formed on said inner peripheral surface so as to be separated from said bottom portion of the stick-like receiving number and including an opening, wherein a gap is formed between said step portion and said bottom portion that communicates with the slit and forms an air passage together with the slit and the opening.

2. The stick-like object receiving member according to claim 1, wherein a plurality of said slits are formed at intervals in the circumferential direction.

3. The stick-like object receiving member according to claim 1, wherein said cylindrical side portion has a collar portion protruding outward in the radial direction on the other end thereof.

4. The stick-like object receiving member according to claim 2, wherein said cylindrical side portion has a collar portion protruding outward in the radial direction on the other end thereof.

5. An instrument comprising:

a stick-like object receiving member comprising:

a cylindrical side portion; and a bottom portion at one end of said cylindrical side portion, and a barrel comprising:

a cylindrical casing in which said stick-like object receiving member is detachably mounted; and a step portion defining a gap with said bottom portion and including an opening, wherein said stick-like object receiving member forms a slit in said cylindrical side portion and said bottom portion thereby defining an air passage through said slit, said gap, and said opening.

6. A The instrument of claim 5, wherein said cylindrical side portion is adapted to engage at least a part of an outer peripheral surface of a stick-like object.

7. The instrument of claim 5, wherein said cylindrical side portion is adapted to surround at least a part of an outer peripheral surface of a stick-like object.

8. The instrument of claim 5, wherein said slit penetrates both said cylindrical side portion and said bottom portion.

9. The instrument of claim 5, wherein said stick-like object receiving member further forms a plurality of slits in said cylindrical side portion and said bottom portion.

10. The instrument of claim 9, wherein said plurality of slits are spaced circumferentially around said stick-like object receiving member.

11. The instrument of claim 5, wherein said cylindrical side portion comprises a collar portion protruding radially outward at another end of said cylindrical side portion.

12. The instrument of claim 11, wherein said cylindrical casing comprises an end face engaging said collar portion.

13. A writing instrument comprising:

an eraser receiver comprising:

a cylindrical side portion; and a bottom portion at one end of said cylindrical side portion, and a barrel comprising:

a cylindrical casing in which said eraser receiver is detachably mounted; and a step portion defining a gap with said bottom portion and including an opening, wherein said eraser receiver forms a slit in said cylindrical side portion and said bottom portion thereby defining an air passage through said slit, said gap, and said opening.

14. The instrument of claim 13, wherein said cylindrical side portion is adapted to engage at least a part of an outer peripheral surface of an eraser.

15. The instrument of claim 13, wherein said cylindrical side portion is adapted to surround at least a part of an outer peripheral surface of an eraser.

16. The instrument of claim 13, wherein said slit penetrates both said cylindrical side portion and said bottom portion.

17. The instrument of claim 13, wherein said eraser receiver further forms a plurality of slits in said cylindrical side portion and said bottom portion.

18. The instrument of claim 17, wherein said plurality of slits are spaced circumferentially around said eraser receiver.

19. The instrument of claim 13, wherein said cylindrical side portion comprises a collar portion protruding radially outward at another end of said cylindrical side portion.

20. The instrument of claim 19, wherein said cylindrical casing comprises an end face engaging said collar portion.

* * * * *